US005538557A

United States Patent [19]

Busker

[11] Patent Number: 5,538,557

[45] Date of Patent: Jul. 23, 1996

[54] SHORT DWELL COATER APPARATUS

[75] Inventor: Leroy H. Busker, Rockton, Ill.

[73] Assignee: Beloit Technologies, Inc., Wilmington, Del.

[21] Appl. No.: 111,368

[22] Filed: Aug. 24, 1993

[51] Int. Cl.[6] ..... B05C 3/12

[52] U.S. Cl. ..... 118/410; 118/419

[58] Field of Search ..... 118/126, 413, 118/410, 411; 427/356

[56] References Cited

U.S. PATENT DOCUMENTS

| | | | |
|---|---|---|---|
| 3,518,964 | 7/1970 | Nagler | 118/410 |
| 4,256,211 | 2/1981 | Damrau et al. | 118/411 |
| 4,643,127 | 2/1987 | Wanke | 118/410 |
| 4,834,018 | 5/1989 | Sollinger et al. | 118/410 |
| 4,836,134 | 6/1989 | Knop | 118/413 |
| 4,903,632 | 2/1990 | Sollinger | 118/410 |
| 4,930,437 | 6/1990 | Eckhard | 118/410 |
| 5,010,840 | 4/1991 | Busker et al. | 118/421 |
| 5,133,996 | 7/1992 | Busker | 427/356 |

FOREIGN PATENT DOCUMENTS

| | | |
|---|---|---|
| 0287759 | 10/1988 | European Pat. Off. . |
| 0426606 | 11/1991 | European Pat. Off. . |

*Primary Examiner*—Brenda A. Lamb

*Attorney, Agent, or Firm*—Dirk J. Veneman; Raymond W. Campbell; Gerald A. Mathews

[57] ABSTRACT

A short dwell coater apparatus is disclosed for applying coating material to a web supported by a backing member. The apparatus includes a housing which defines an application zone having an upstream and a downstream end. The application zone extends in a cross-machine direction across the web and is connected to a source of the coating material such that the coating material is applied to the web during movement of the web past the application zone. An elongate pipe is disposed within the application zone and extends in a cross-machine direction across the application zone. The pipe defines at least one orifice for the passage therethrough of the coating material. The pipe is connected to the source of coating material such that the coating material flows through the pipe and through the orifice for supplying coating material to the application zone. A vane is rigidly secured to the pipe and extends in a machine direction away from the pipe towards the web such that coating material supplied through the orifice generates a hydrodynamic wedge between the vane and the web for reducing entrained air vortices within the application zone. A metering blade is disposed adjacent to the downstream end of the application zone for metering excess coating from the web.

9 Claims, 2 Drawing Sheets

SHORT DWELL COATER APPARATUS

BACKGROUND OF THE INVENTION

1. Field Of The Invention

The present invention relates to a short dwell coater apparatus for applying coating material to a web. More specifically, the present invention relates to a short dwell coater apparatus for supplying coating material to a web which is supported by a backing member.

2. Information Disclosure Statement

In the coating art, short dwell coaters have been used for applying coating material to the surface of a web as the web supported by a backing roll moves past the coater apparatus.

More specifically, short dwell coaters include a coater housing which defines a cavity connected to a source of pressurized coating material.

The cavity includes an application zone for the passage therepast of the web to be coated.

One advantage of the aforementioned short dwell coater is the short residence time of the web as the web moves past the application zone. The short residence time permits the application of coating material to the web while avoiding excessive penetration of the coating material into the surface of the web. Accordingly, only a very thin film of coating material is applied to the web, thereby reducing the amount of coating material required for a coating operation.

Additionally, due to the reduced penetration of coating material through the surface of the web, the strength of the resultant coated web is maintained so that web breakage is reduced.

However, in certain applications, it is desirable to increase the pressure at which coating material is applied to the web while avoiding the disadvantages of a prior art flooded nip coater in which a roll rotating through a pan of coating material applies coating material onto the sheet.

Additionally, when operating a short dwell coater above 3,000 feet per minute, streaking of the resultant coating has been a problem. Such streaking is caused by entrainment of air by the web as the web extends into and past the application zone. The air forms vortices within the application zone and such vortices intermittently extend to and past the downstream metering blade of the short dwell coater to form streaks in the resultant coating.

The present invention seeks to overcome the aforementioned problems by providing a short dwell coater which includes a cross-machine directional pipe supplied with coating material and a vane extending from the pipe towards the web for generating a hydrodynamic wedge between the vane and the web.

Accordingly, the present invention provides a short dwell coater apparatus for applying coating to sheet materials and eliminates vortexing in the application zone.

An object of the present invention is the provision of a short dwell coater that overcomes the aforementioned problems of the prior art coaters and which makes a considerable contribution to the art of applying coating material to a moving web.

Another object of the present invention is the provision of a short dwell coater which includes a vane for generating a hydraulic wedge between the vane and the web for reducing entrained air vortices within the application zone.

Other objects and advantages of the present invention will be readily apparent to those skilled in the art by a consideration of the detailed description contained hereinafter, taken in conjunction with the annexed drawings.

SUMMARY OF THE INVENTION

The present invention relates to a short dwell coater apparatus and method for applying coating material to a web supported by a backing member. The apparatus includes a housing which defines an application zone having an upstream and a downstream end. The application zone extends in a cross-machine direction across the web. The application zone is connected to a source of coating material such that the coating material is applied to the web during movement of the web past the application zone.

An elongate pipe is disposed within the application zone and extends in a cross-machine direction across the application zone. The pipe defines an orifice means for the passage therethrough of the coating material. The pipe is connected to the source of coating material such that coating material flows through the pipe and through the orifice means for supplying coating material to the application zone.

A vane is rigidly secured to the pipe and extends in a machine direction away from the pipe towards the web. The arrangement is such that coating material is supplied through the orifice means and generates a hydrodynamic wedge between the vane and the web for reducing entrained air vortices within the application zone.

A metering blade is disposed adjacent to the downstream end of the application zone for metering excess coating from the web.

In a more specific embodiment of the present invention, the housing also defines a drain which permits the flow therethrough of excess coating material.

The housing also defines an overflow between the upstream end, the housing and the web such that a portion of the coating material within the application zone overflows from the application zone past the overflow.

The elongate pipe includes a first and second end, with the first end being connected to the source of coating material. The first and second end of the pipe rotatably cooperate with the housing.

In a specific embodiment of the present invention, means are provided for rotating the pipe relative to the housing for permitting the disposition of the vane relative to the web to be varied. The arrangement is such that when the pipe is rotated, the angle between the vane and the web is varied.

In one embodiment of the present invention, the orifice means is an elongate slot which extends in a cross-machine direction between the first and second end of the pipe. The slot faces towards the web.

In another embodiment of the present invention, the orifice means includes a plurality of apertures which are spaced in a row along the pipe between the first and the second end thereof. The apertures face towards the web.

The vane has an upstream and a downstream extremity. The upstream extremity is rigidly secured to the pipe, and the downstream extremity is disposed adjacent to the web. The arrangement is such that coating material flows through the orifice means in a direction from the upstream towards the downstream extremity of the vane. The coating material is pressed by the vane against the web so that the vane generates the hydrodynamic wedge of coating material between the vane and the web. The arrangement is such that any air vortices entrained within the application zone due to flow of air past the upstream end of the application zone is smoothed out and inhibited by the vane so that streaking of the resultant coated web is reduced.

The coating apparatus in a preferred embodiment also includes adjustment means disposed between the housing and the pipe for controllably adjusting the distance between the pipe and the web.

Many modifications and variations of the present invention will be readily apparent to those skilled in the art by a consideration of the detailed description contained hereinafter, taken in conjunction with the annexed drawings. However, such modifications and variations fall within the spirit and scope of the present invention as defined by the appended claims.

BRIEF DESCRIPTION OF THE DRAWINGS

Similar reference characters refer to similar parts throughout the views of the drawings.

DETAILED DESCRIPTION OF THE DRAWINGS

Figure 1:
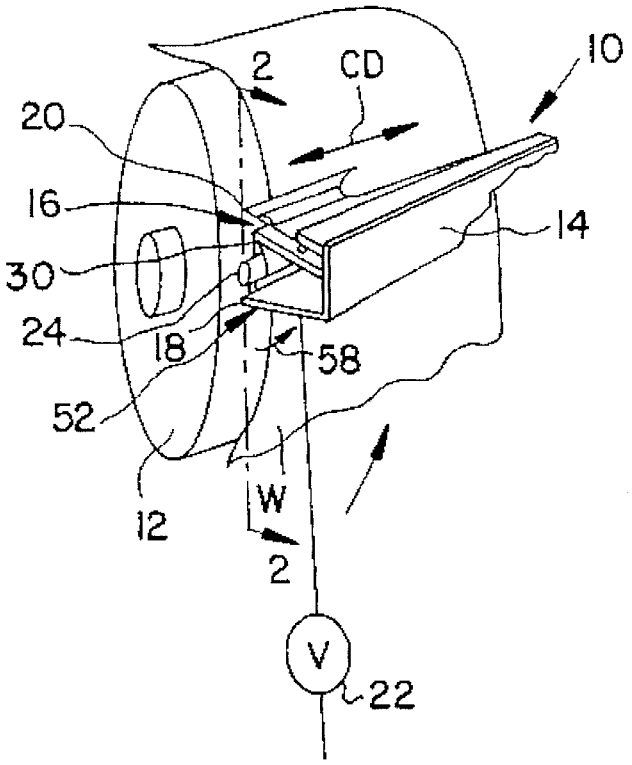
FIG. 1 is a side-elevational view of the short dwell coater apparatus according to the present invention for applying coating material to a web supported by a backing member.

FIG. 1 is a side-elevational view of a short dwell coater apparatus, generally designated 10 according to the present invention, for applying coating material to a web W supported by a backing member 12.

The apparatus 10 includes a housing 14 which defines an application zone, generally designated 16, having an upstream and a downstream end 18 and 20, respectively. The application zone 16 extends in a cross-machine direction, as indicated by the arrow CD. The application zone 16 is connected to a source of coating material 22 such that the coating material 22 is applied to the web W during movement of the web W past the application zone 16.

Figure 2:
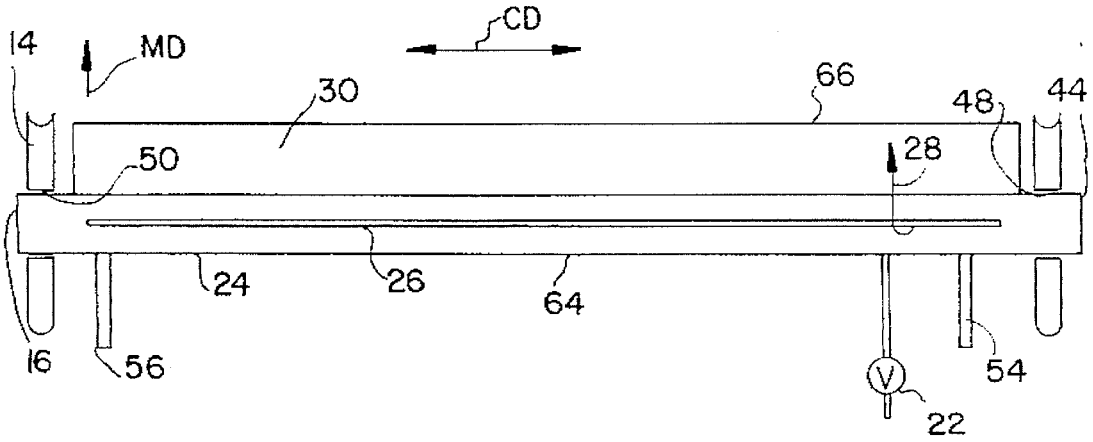
FIG. 2 is an enlarged sectional view of the elongate pipe and vane taken on the line 2—2 of FIG. 1.

An elongate pipe 24 is disposed within the application zone 16 and extends in a cross-machine direction CD across the application zone 16. FIG. 2 is an enlarged sectional view taken on the line 2—2 of FIG. 1. FIG. 2 shows the pipe 24, which defines orifice means 26, for the passage therethrough of the coating material 22. The pipe 24 is connected to the source of coating material 22 such that coating material 22 flows, as indicated by the arrow 28, through the pipe 24 and through the orifice means 26 for supplying coating material 22 to the application zone 16.

Figure 3:
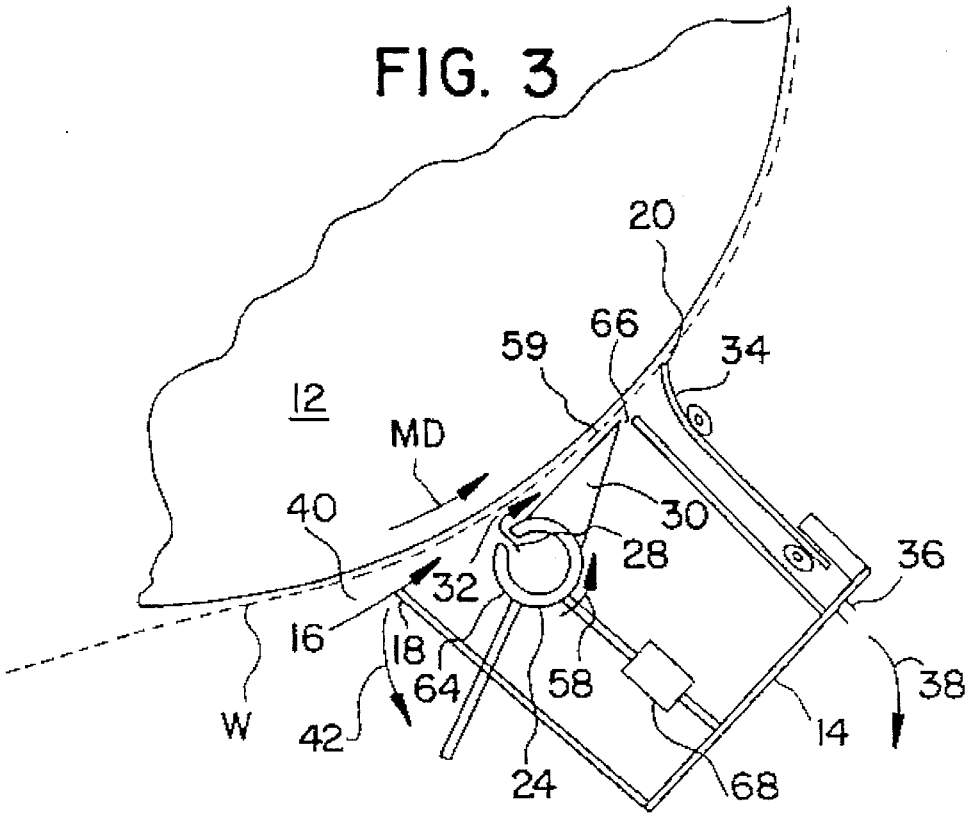
FIG. 3 is an enlarged side-elevational view of the apparatus shown in FIG. 1.

FIG. 3 is an enlarged side-elevational view of the apparatus shown in FIG. 1. FIG. 3 shows a vane 30 which is rigidly secured to the pipe 24 and which extends in a machine direction, as indicated by the arrow MD, away from the pipe 24 towards the web W such that coating material 22 supplied through the orifice means 26, as indicated by the arrow 28, generates a hydrodynamic wedge 32 between the vane 30 and the web W. Such hydrodynamic wedge 32 reduces entrained air vortices within the application zone 16.

A metering blade 34 is disposed adjacent to the downstream end 20 of the application zone 16 for metering excess coating from the web W.

As shown in FIG. 3, the housing 14 also includes a drain 36 which permits the flow therethrough of excess coating material, as indicated by the arrow 38.

The housing 14 also defines an overflow 40 between the upstream end 18 of the housing 14 and the web W such that a portion of the coating material within the application zone, as indicated by the arrow 42, overflows from the application zone 16 past the overflow 40.

FIG. 2 is an enlarged sectional view taken on the line 2—2 of FIG. 1 and shows the elongate pipe 24 and vane 30. As shown in FIG. 2, the elongate pipe 24 includes a first and a second end 44 and 46, respectively. The Pipe 24 is connected to the source of coating material 22 adjacent to the first end 44.

The first and second ends 44 and 46 of the pipe 24 rotatably cooperate with the housing 14. More specifically, the housing 14 includes bearings 48 and 50 which receive the respective ends 44 and 46 of the pipe 24 for rotatably supporting the same.

The elongate pipe 24 includes means, generally designated 52 for rotating the pipe 24 relative to the housing 14. The means 52 include a first and second arm 54 and 56, respectively, which extend from the first and second ends 44 and 46 of the pipe 24. Such means 54 and 56 permit rotation of the pipe 24 relative to the housing 14 for permitting the disposition of the vane 30 relative to the web W to be varied. The arrangement is such that when the pipe 24 is rotated, as indicated by the arrow 58, the angle 59 between the vane 30 and the web W is varied.

In one embodiment of the present invention, as shown in FIG. 2, the orifice means is an elongate slot 26 which extends in a cross-machine direction CD between the first and second end 44 and 46, respectively, of the pipe 24. The slot 26 faces towards the web W, as shown particularly in FIG. 3.

Figure 2A:
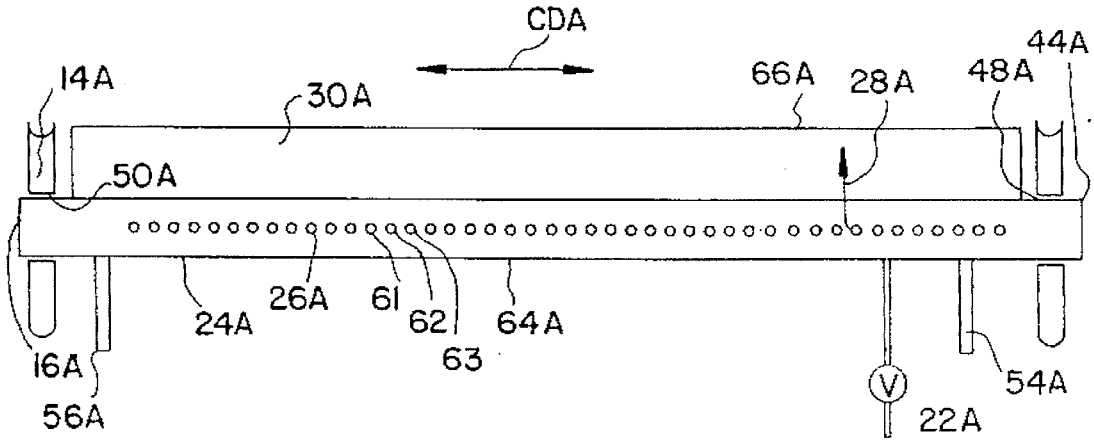
FIG. 2A is a similar view to that shown in FIG. 2, but shows an alternative embodiment of the present invention.

In an alternative embodiment of the present invention, as shown in FIG. 2A, the orifice means 26A includes a plurality of apertures 60,61 and 62 which are spaced in a row along the pipe 24 between the first and second end 44 and 46 thereof. The apertures 60 to 62 face towards the web W.

As shown in FIGS. 1 and 2, the vane 30 has an upstream and a downstream extremity 64 and 66, respectively. The upstream extremity 64 is rigidly secured to the pipe 24. The downstream extremity 66 is disposed adjacent to the web W. The arrangement is such that coating material 22 flowing through the orifice means 26 flows in a direction, as indicated by the arrow 28, in a direction from the upstream extremity 64 towards the downstream extremity 66 of the vane 30. The coating material 22 is pressed by the vane 30 against the web W so that the vane 30 generates the hydrodynamic wedge 32 of coating material 22 between the vane 30 and the web W. The arrangement is such that any air vortices entrained within the application zone 16 due to flow of air past the upstream end 18 of the application zone 16 is smoothed out and inhibited by the vane 30 so that streaking of the resultant coated web W is reduced.

FIG. 3 shows an adjustment means, generally designated 68, disposed between the housing 14 and the pipe 24 for controllably adjusting the distance between the pipe 24 and the web W.

The present invention provides a short dwell coater which overcomes the problem of streaking which occurs above 3,000 feet per minute.

Additionally, the coater, according to the present invention, enables an increase in the application pressure of the coating applied to the web.

What is claimed is:

1. A short dwell coater apparatus for applying coating material to a web supported by a backing member, said apparatus comprising:

a housing defining an application zone having an upstream and a downstream end relative to the movement of the web past said application zone, said application zone extending in a cross-machine direction across the web, said application zone being connected to a source of the coating material such that the coating material is applied to the web during movement of the web past said application zone;

an elongate pipe disposed within said application zone and extending in a cross-machine direction across said application zone, said pipe being selectively rotatable within said application zone, during application of the coating material, said pipe defining orifice means for the passage therethrough of coating material, said pipe being connected to the source of coating material such that coating material flows through said pipe and through said orifice means for supplying coating material to said application zone;

a vane rigidly secured to said pipe and extending in a machine direction away from said pipe towards the web such that coating material supplied through said orifice means generates a hydrodynamic wedge between said vane and the web for reducing entrained air vortices within said application zone; and a metering blade disposed adjacent to said downstream end of said application zone for metering excess coating material from the web.

2. A short dwell coater apparatus as set forth in claim 1, wherein said housing further defines a drain which permits the flow therethrough of said excess coating material.

3. A short dwell coater apparatus as set forth in claim 1, wherein said housing further defines an overflow between said upstream end of said housing and the web such that a portion of the coating material within said application zone is permitted to flow from said application zone and past said overflow.

4. A short dwell coater apparatus as set forth in claim 1, wherein said vane has an upstream and a downstream extremity, said upstream extremity being rigidly secured to said pipe, said downstream extremity being disposed adjacent to the web, the arrangement being such that coating material flowing through said orifice means flows in a direction from said upstream towards said downstream extremity of said vane, the coating material being pressed by said vane against the web so that said vane generates said hydrodynamic wedge of the coating material between said vane and the web, the arrangement is such that any air vortices entrained within said application zone due to flow of air past said upstream end of said application zone is smoothed out and inhibited by said vane so that streaking of a resultant coated web is reduced.

5. A short dwell coater apparatus as set forth in claim 1, wherein said coater apparatus further includes:

adjustment means disposed between said housing and said pipe for controllably adjusting the distance between said pipe and the web.

6. A short dwell coater apparatus for applying coating material to a web supported by a backing member, said apparatus comprising:

a housing defining an application zone having an upstream and a downstream end relative to the movement of the web past said application zone, said application zone extending in a cross-machine direction across the web, said application zone being connected to a source of the coating material such that the coating material is applied to the web during movement of the web past said application zone;

an elongate pipe disposed within said application zone and extending in a cross machine direction across said application zone, said pipe defining orifice means for the passage therethrough of coating material, said pipe being connected to the source of coating material such that coating material flows through said pipe and through said orifice means for supplying coating material to said application zone;

a vane rigidly secured to said pipe and extending in a machine direction away from said pipe towards the web such that coating material supplied through said orifice means generates a hydrodynamic web wedge between said vane and the web for reducing entrained air vortices within said application zone;

a metering blade disposed adjacent to said downstream end of said application zone for metering excess coating material from the web; said elongate pipe including:

a first and a second end, said first end being connected to said source of coating material; and said first and second ends of said pipe rotatably cooperating with said housing.

7. A short dwell coater apparatus as set forth in claim 4, wherein said elongate pipe includes:

means for rotating said pipe relative to said housing for permitting the disposition of the vane relative to the web to be varied, the arrangement being such that when said pipe is rotated, the angle between said vane and the web is varied.

8. A short dwell coater apparatus as set forth in claim 6, wherein said orifice means is an elongate slot which extends in a cross-machine direction between said first and second end of said pipe, said slot facing towards the web.

9. A short dwell coater apparatus as set forth in claim 6, wherein said orifice means includes:

a plurality of apertures spaced in a row along said pipe between said first and second ends thereof, said apertures facing towards the web.

* * * * *